US011039686B2

(12) United States Patent
Min

(10) Patent No.: US 11,039,686 B2
(45) Date of Patent: Jun. 22, 2021

(54) PREFABRICATED SHELF ASSEMBLY

(71) Applicant: Speedrack Co., Ltd., Gimpo-si (KR)

(72) Inventor: Hyo-ky Min, Seoul (KR)

(73) Assignee: SPEEDRACK CO., LTD., Gimpo-si (KR)

( * ) Notice: Subject to any disclaimer, the term of this patent is extended or adjusted under 35 U.S.C. 154(b) by 0 days.

(21) Appl. No.: 16/705,897

(22) Filed: Dec. 6, 2019

(65) Prior Publication Data

US 2020/0305596 A1 Oct. 1, 2020

(30) Foreign Application Priority Data

Mar. 26, 2019 (KR) ..... 10-2019-0034102

(51) Int. Cl.

| | |
|---|---|
| ***A47B 57/22*** | (2006.01) |
| ***A47B 96/06*** | (2006.01) |
| ***A47B 96/14*** | (2006.01) |
| ***A47B 96/02*** | (2006.01) |

(Continued)

(52) U.S. Cl.

CPC ..... *A47B 57/22* (2013.01); *A47B 47/0083* (2013.01); *A47B 96/024* (2013.01); *A47B 96/068* (2013.01); *A47B 96/1408* (2013.01); *A47B 55/02* (2013.01); *A47B 2220/0002* (2013.01); *A47B 2220/0036* (2013.01); *A47B 2230/0003* (2013.01)

(58) Field of Classification Search

CPC ... A47B 57/22; A47B 47/0083; A47B 96/024; A47B 96/068; A47B 96/1408; A47B 55/02; A47B 2220/0002; A47B 2220/0036; A47B 2230/0003; A47B 57/40; A47B 57/0058; A47B 57/20; A47B 87/00; A47B 47/02; A47B 47/03; A47B 83/00

USPC ..... 108/106, 107, 109, 110; 312/265.1–265.4, 263, 107–109, 111; 211/187

See application file for complete search history.

(56) References Cited

U.S. PATENT DOCUMENTS 1,734,161 A * 11/1929 Du Plessis ..... A47F 3/12 312/107
1,897,568 A * 2/1933 Bales ..... A47B 47/02 312/265.4

(Continued)

FOREIGN PATENT DOCUMENTS

FR 1340300 * 10/1963
FR 1357057 * 4/1964

(Continued)

*Primary Examiner* — Janet M Wilkens
(74) *Attorney, Agent, or Firm* — Cantor Colburn LLP

(57) ABSTRACT

Provided is a prefabricated shelf assembly. The prefabricated shelf assembly enables a shelf to be conveniently and rapidly assembled, enables the assembled shelf to be firmly maintained, and allows an outer wall and a door to be assembled as a user desires, thus realizing a high-quality product, and allows the length of the shelf to be adjusted via an assembly kit or allows a plurality of shelves to be optionally arranged and then be assembled depending on an installation environment, and adopts a coupling method using a fitting protrusion and a fitting hole, so that the shelf may be re-assembled by separating only a support plate even when the assembly has been completed, and thereby the height of a storage part can be easily changed.

4 Claims, 27 Drawing Sheets

(51) Int. Cl.
*A47B 47/00* (2006.01)
*A47B 55/02* (2006.01)

(56) References Cited

U.S. PATENT DOCUMENTS 3,276,831 A * 10/1966 Lappin ..... A47B 87/00 312/108
3,637,087 A * 1/1972 Denny ..... A47B 57/402 211/192
3,736,035 A * 5/1973 Brown ..... A47B 97/001 312/107
3,847,458 A * 11/1974 Nowak ..... A47B 87/02 312/108
5,463,966 A * 11/1995 Nilsson ..... F16B 12/34 108/110
5,601,038 A * 2/1997 Welch ..... A47B 55/02 108/107
9,723,925 B1 * 8/2017 Tsai ..... A47B 47/00
2002/0171338 A1 * 11/2002 Wetterberg ..... A47B 87/0207 312/265.1
2005/0127802 A1 * 6/2005 Chen ..... A47B 88/407 312/265.4
2014/0034593 A1 * 2/2014 Chen ..... A47B 47/021 211/134
2015/0313357 A1 * 11/2015 David ..... A47B 57/20 211/187
2016/0120305 A1 * 5/2016 Kassanoff ..... A47B 57/30 312/111
2016/0270529 A1 * 9/2016 Hollins ..... F16B 2/08

FOREIGN PATENT DOCUMENTS

FR 2216760 * 8/1974
KR 200228609 6/2001
KR 20050078911 8/2005
KR 100677912 2/2007
KR 20090026588 3/2009
KR 20180027058 3/2018
KR 101845802 4/2018
KR 300964322 7/2018
KR 1991463 * 6/2019

* cited by examiner

PREFABRICATED SHELF ASSEMBLY

BACKGROUND OF THE INVENTION

Field of the Invention

The present invention relates to a prefabricated shelf assembly. More particularly, the invention relates to a prefabricated shelf assembly, which enables a shelf to be conveniently and rapidly assembled, enables the assembled shelf to be firmly maintained, and allows an outer wall and a door to be assembled as a user desires, thus realizing a high-quality product, and allows the length of the shelf to be adjusted via an assembly kit or allows a plurality of shelves to be optionally arranged and then be assembled depending on an installation environment, and adopts a coupling method using a fitting protrusion and a fitting hole, so that the shelf may be re-assembled by separating only a support plate even when the assembly has been completed, and thereby the height of a storage part can be easily changed.

Description of the Related Art

For a shelf for storing articles, various technologies have been proposed to adjust the height of the shelf according to the size of the articles.

As the related art, Korean UM. Registration No. 20-0228609, Korean Patent No. 10-2009-0026588, and Korean Patent Application Publication No. 10-2005-0078911 have been proposed.

They suggest an angle coupling structure or means for adjusting the height of the shelf. However, they are problematic in that a bolt should be fastened using a tool to detach or attach the shelf, thus causing a worker inconvenience, and the shelf has difficulty bearing a high load due to the structure of a coupling protrusion for fixing the shelf, and its manufacture is complicated.

Particularly, according to the related art, the shelf is merely configured to store articles thereon, so that its utilization is poor. Further, in the case of connecting two or more shelves, the entire shape is fixed, so that many restrictions are imposed on an installation place, and the design of the assembled shelves is monotonous, which makes it impossible to create various designs.

Accordingly, the inventor(s) of the present invention have proposed a prefabricated shelf (Patent No. 10-1845802) in order to solve the problems. However, this shelf is problematic in that a coupling groove of a frame is exposed to the outside, so that all sides are open and consequently an appearance is poor. Therefore, there is a need for a prefabricated shelf that overcomes the drawback and achieves a high quality.

SUMMARY OF THE INVENTION

The present invention has been made in order to solve the above-mentioned problems in the prior art and an object of the present disclosure is to provide a prefabricated shelf assembly, which allows an outer-wall unit and a door unit to be assembled with a main body composed of a vertical frame and a horizontal frame, as a user desires, thus realizing a higher quality compared to the conventional prefabricated shelf.

Another object of the present disclosure is to provide a prefabricated shelf assembly, which includes an assembly kit having various brackets, thus allowing a user to arrange two or more main bodies depending on an installation environment, as the user desires, and enabling the shelf assembly to be stably fixed.

A further object of the present disclosure is to provide a prefabricated shelf assembly, which can change the vertical length of a vertical frame and allows a main body to be installed even at a corner when main bodies are perpendicularly arranged.

In order to achieve the objects of the present invention, the invention provides a prefabricated shelf assembly including: a main body including a vertical frame having a first support part, a second support part, and a plurality of fitting holes formed in the first and second support parts; and a horizontal frame including a connection part and a holding part, with fitting protrusions being provided on both sides of the connection part to be fitted into the fitting holes, wherein the vertical frame and the horizontal frame are coupled to define a plurality of storage parts of the main body; a support plate configured to be held on the holding part of the horizontal frame; an outer-wall unit provided on some or all of the storage parts, and including an outer wall provided on either or both of a side surface and a rear surface of each of the storage parts, and an outer-wall bracket coupled to the vertical frame to support a rear end of the outer wall; and a door unit provided on some or all of the storage parts, and including a rail provided on a front of the storage part, and a door coupled to slide along the rail and opening or closing the storage part.

As described above, a prefabricated shelf assembly according to the present invention includes a main body having a vertical frame and a horizontal frame to define a plurality of storage parts, an outer-wall unit assembled to cover either or both of a side surface and a rear surface of the storage part, and a door unit assembled to open or close a front of the storage part, so that the outer-wall unit and the door unit can be assembled with the storage part at a desired position, thus more perfectly satisfying a user's needs, and achieving a higher quality compared to the conventional shelf assembly.

Furthermore, as a fitting hole provided to connect the vertical frame with the horizontal frame is not exposed to the outside, a good appearance is guaranteed.

The vertical length of the main body can be changed via an assembly kit including various brackets and connectors. Moreover, in the case of arranging a plurality of main bodies, the main body may be arranged even at a corner and then may be firmly fixed using the assembly kit, thus consequently enhancing stability and versatility.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
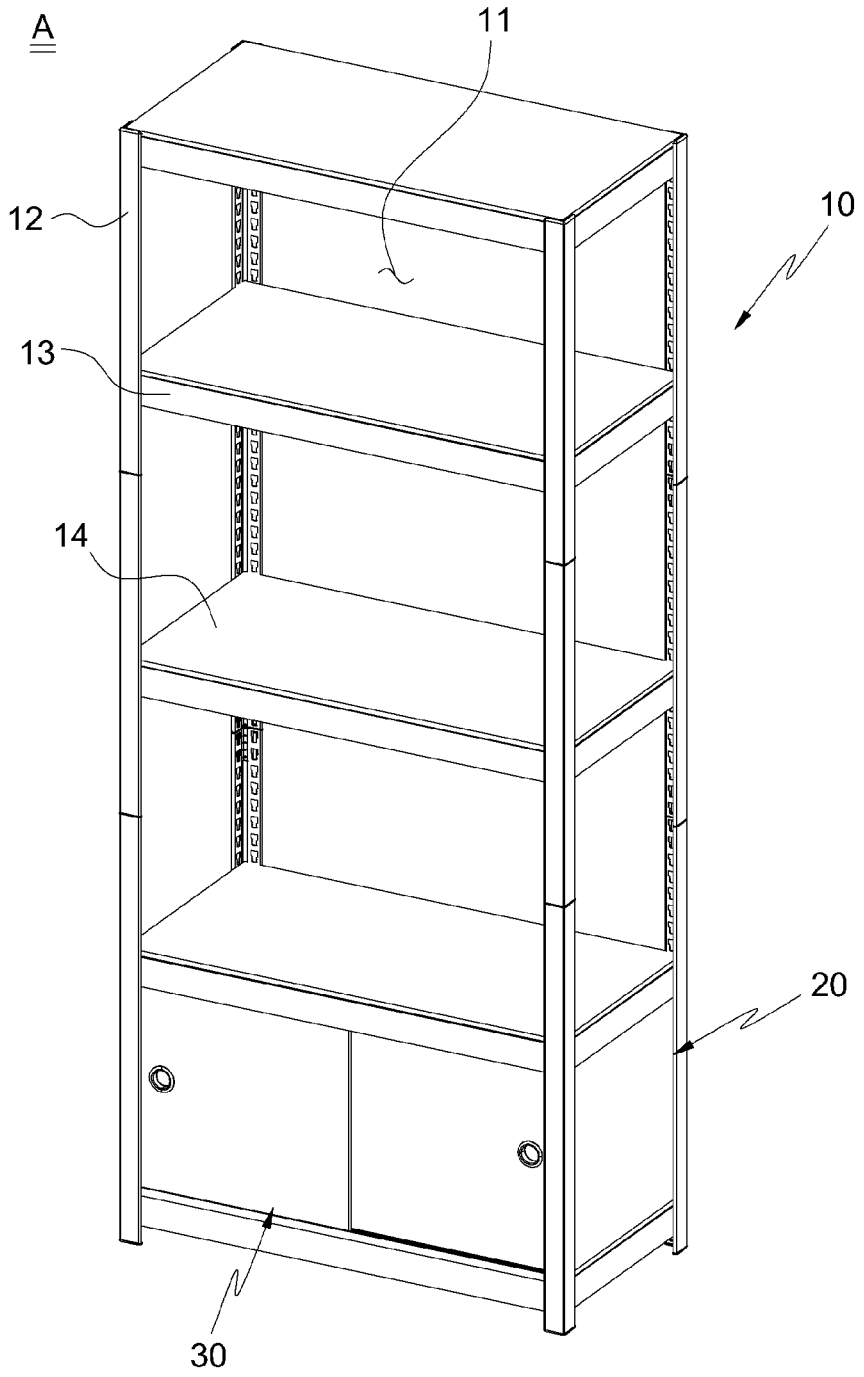
FIG. 1 is a perspective view showing a prefabricated shelf assembly according to the present invention.

Hereinafter, the present invention will be described in detail with reference to the accompanying drawings.

Since the present invention may be embodied in many different forms, aspects (or embodiments) of the invention will be described in detail herein. However, the invention should not be construed as limited to the embodiments set forth herein. Rather, all changes that fall within the bounds of the present invention, or the equivalence of the bounds are therefore intended to be embraced by the present invention.

The same reference numerals throughout the drawings, that is, the same reference numerals for the second digit or the first digit, or for the second digit, the first digit and a letter of the alphabet, denote elements having the same function. Unless otherwise specified, the elements denoted by the reference numerals are to be assumed to comply with the above-mentioned reference scheme.

In the drawings, the thicknesses of lines or the sizes of elements may be exaggerated or simplified to more clearly and conveniently illustrate the present invention, but the bounds of the present invention must not be interpreted as being limited thereto.

The terminology used herein is for the purpose of describing particular embodiments only and is not intended to be limiting. As used herein, the singular forms "a", "an", and "the" are intended to include plural forms as well, unless the context clearly indicates otherwise. It will be further understood that the terms "comprises" and/or "comprising", or "includes" and/or "including" when used in this specification, specify the presence of stated features, numbers, steps, operations, elements, components, and/or combinations thereof, but do not preclude the presence or addition of one or more other features, numbers, steps, operations, elements, components, and/or combinations thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As shown in FIG. 1, a prefabricated shelf assembly A according to the present invention includes a main body 10 that defines a plurality of storage parts 11 through a plurality of vertical frames 12, a plurality of horizontal frames 13, and a support plate 14, an outer-wall unit 20 that is provided on the storage part 11, and a door unit 30. The assembly includes an assembly kit K that has various brackets to be assembled and arranged in various shapes. The assembly kit K can be used as desired to increase the diversity of assembly, and can achieve a high-quality of product through the outer-wall unit 20 and the door unit 30.

In the description of the present invention, the brackets have various shapes according to their intended use, so that the respective brackets will be described with reference to the accompanying drawings. Terms for the different brackets may be interchangeably used, but refer to different components with reference to the accompanying drawings.

For the convenience of description, FIG. 1 shows an assembled state, and FIGS. 2A to 12 partially show the shape and use of respective components. It is to be noted that respective components may be implemented by a user's choice.

Hereinafter, the respective components will be described in detail with reference to the accompanying drawings.

First, as shown in FIGS. 2A, 2B, 2C, 3A, 3B, and 3C, the main body 10 of the present invention includes the vertical frame 12 that is composed of a first support part 121 and a second support part 122 each having a rectangular shape, and a plurality of fitting holes 16 formed in the first support part 121 and the second support part 122, and the horizontal frame 13 that is composed of a connection part 131 and a holding part 133 each having a rectangular shape, and fitting protrusions 15 provided on both sides of the connection part 131 to be fitted into the corresponding fitting holes 16, so that the horizontal frame 13 is coupled to the vertical frame 12 to define the plurality of storage parts 11. The first support part 121 of the vertical frame 12 includes a 1-1-th support part 121*a* formed on the outside, and a 1-2-th support part 121*b* bent from the 1-1-th support part 121*a* and formed on the inside of the 1-1-th support part 121*a* to be spaced apart therefrom. The second support part 122 of the vertical frame 12 includes a 2-1-th support part 122*a* formed on the outside, and a 2-2-th support part 122*b* bent from the 2-1-th support part 122*a* and formed on the inside of the 2-1-th support part 122*a* to be spaced apart therefrom. The fitting holes 16 are formed only in the 1-2-th support part 121*b* and the 2-2-th support part 122*b*.

The vertical frame 12 will be described in detail.

Figure 2A:
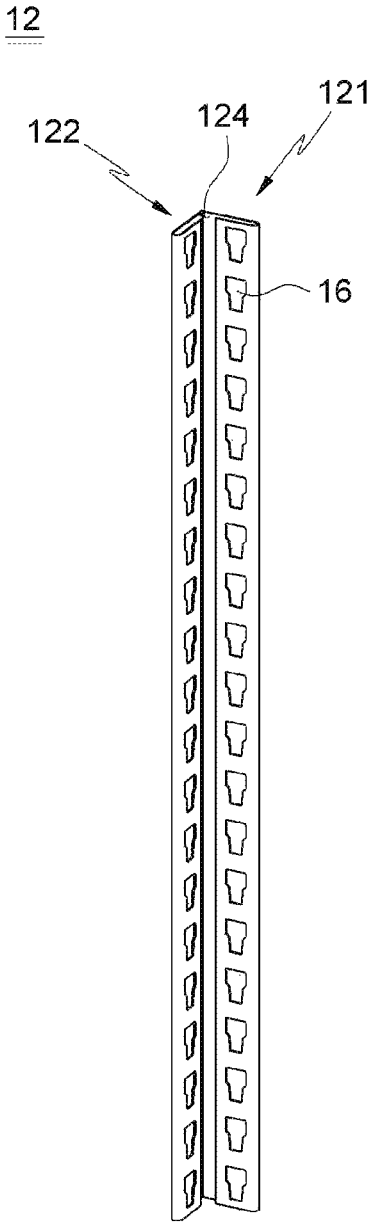
FIGS. 2A and 2B are detailed views showing a vertical frame according to the present invention.
Figure 2B:
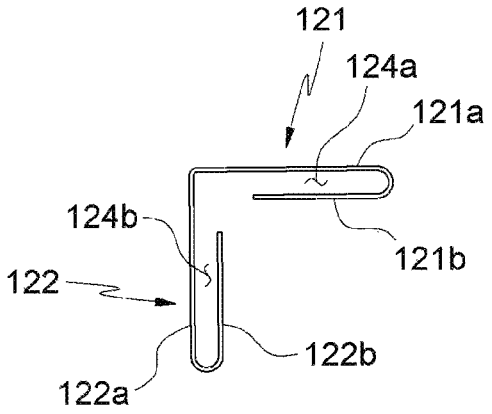

As shown in FIGS. 2A and 2B, the vertical frame 12 is a frame that is made to have a predetermined length by bending the first support part 121 and the second support part 122 at right angles. The first support part 121 includes the 1-1-th support part 121*a* exposed to the outer surface, and the 1-2-th support part 121*b* bent from the 1-1-th support part 121*a* at 180 degrees and defining a first spacing groove 124*a* to be spaced apart from the 1-1-th support part 121*a* by a predetermined distance.

Similarly to the first support part 121, the second support part 122 includes the 2-1-th support part 122*a* exposed to the outer surface, and the 2-2-th support part 122*b* bent from the 2-1-th support part 122*a* at 180 degrees and defining a second spacing groove 124*b* to be spaced apart from the 2-1-th support part 122*a* by a predetermined distance (hereinafter, the first spacing groove 124*a* and the second spacing groove 124*b* are collectively referred to as a 'spacing groove 124').

In addition, as the fitting holes 16 are formed in the 1-2-th support part 121*b* and the 2-2-th support part 122*b*, and no holes are formed in the 1-1-th support part 121*a* and the 2-1-th support part 122*a*, the fitting holes 16 are not exposed to the outer surface after the shelf is installed, thus providing a better appearance.

The spacing groove 124 is provided to define a space where parts of the fitting protrusions 15 passing through the fitting holes 16 may remain, when the fitting protrusions 15 that will be described later are fitted into the fitting holes 16. The plurality of fitting holes 16 is formed at regular intervals to adjust the assembled height of the horizontal frame 13 when the horizontal frame 13 is assembled with the vertical frame 12. One fitting hole 16 may be arranged in one row, or two or more fitting holes 16 may be arranged in multiple rows in a longitudinal direction.

Figure 2C:
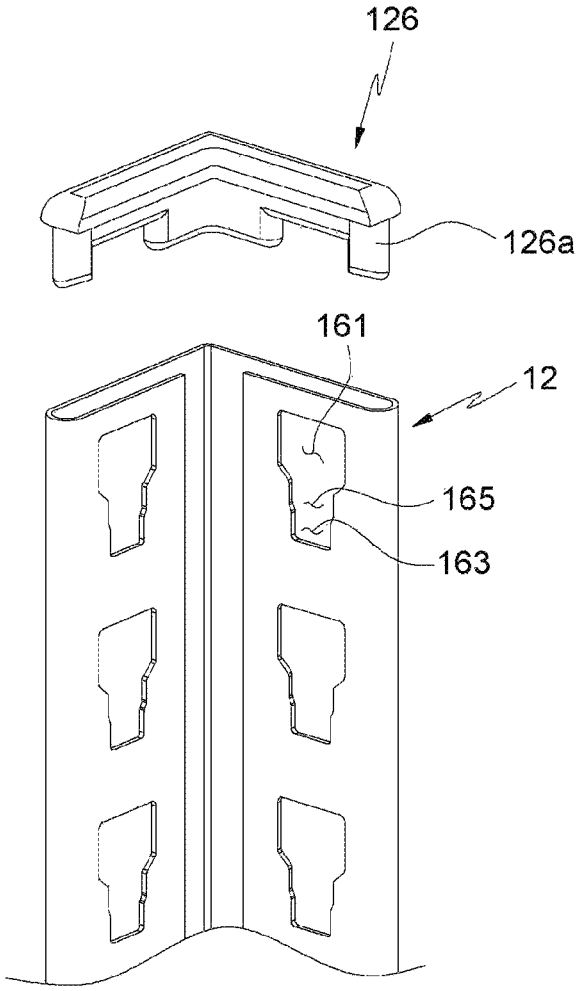
FIG. 2C is a view showing a process of assembling the vertical frame according to the present invention.

Moreover, a frame cap 126 may be further provided to close the uppermost end or the lowermost end, when the vertical frame 12 is installed. As shown in FIG. 2C, the frame cap 126 includes an 'L'-shaped fitting part 126*a* that is fitted into the spacing groove 124 to prevent an end of the vertical frame 12 from being exposed to the outside. The frame cap 126 is preferably made of a soft material such as rubber or silicone rather than a hard material to prevent it from slipping when the frame cap is coupled to a lower portion of the vertical frame 12, provide a good appearance, and prevent a user from being injured by an edge.

Figure 3A:
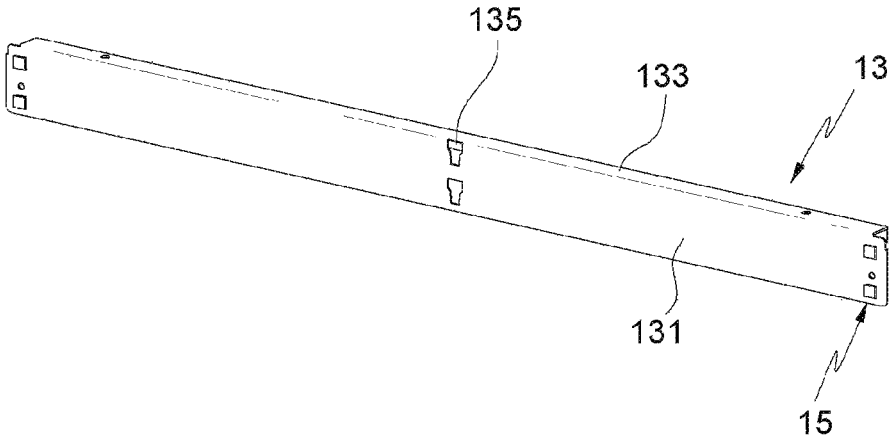
FIGS. 3A, 3B, and 3C are detailed views showing a horizontal frame according to the present invention.
Figure 3B:
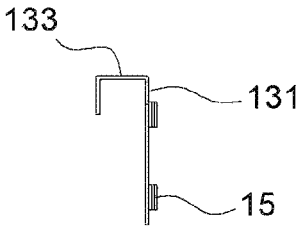
Figure 3C:
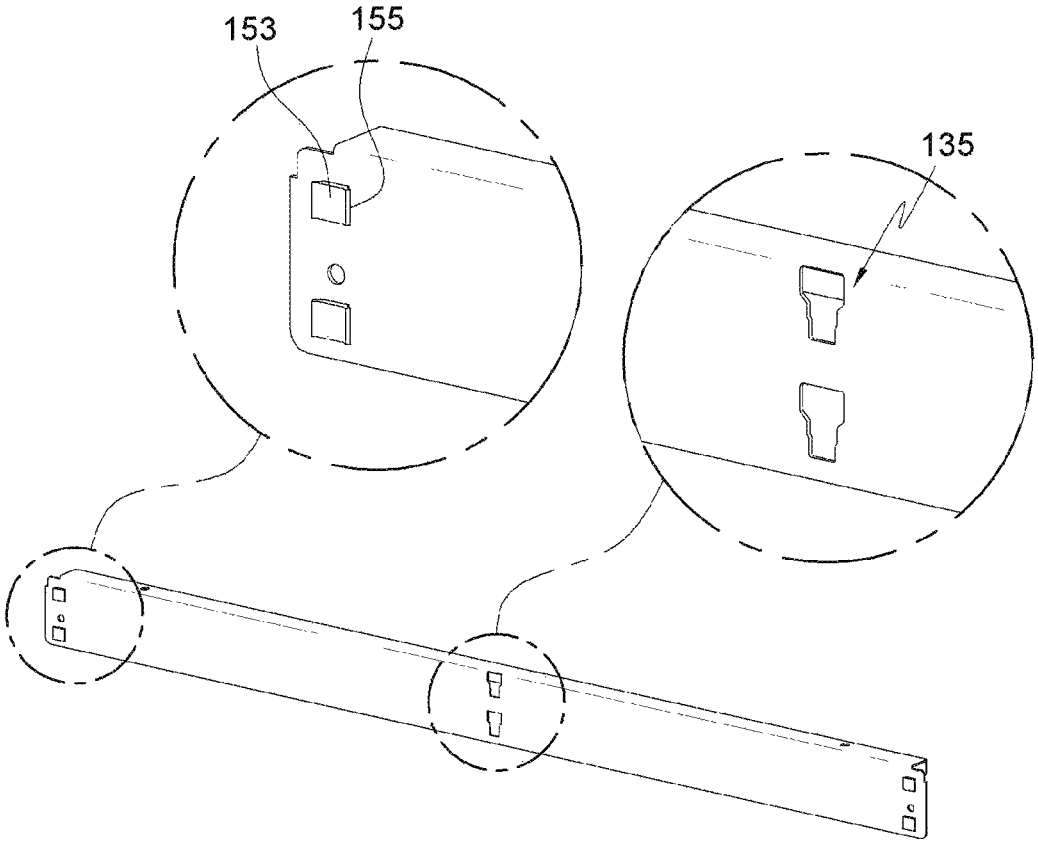

FIGS. 3A, 3B, and 3C show the horizontal frame 13 included in the main body 10. As mentioned above, the horizontal frame 13 includes the connection part 131 and the holding part 133 that is provided on an upper portion of the connection part 131 to be perpendicular thereto (although a rail forming part 311*c* bent downwards from the holding part 133 may be further provided, this is provided to perform the function of an upper rail 311 that will be described later and is not an essential component, and will be described in greater detail when the upper rail 311 is described below).

Furthermore, the fitting protrusions 15 are provided on both sides of the horizontal frame 13. A plurality of fitting protrusions 15 may be provided in a vertical direction to be spaced apart from each other by a predetermined distance (the distance is equal to the vertical spacing distance between the fitting holes 16), or a single fitting protrusion may be provided. However, the plurality of fitting protrusions is provided to ensure stability when assembled. If the fitting holes 16 are arranged in multiple rows, the plurality of fitting protrusions 15 is preferably arranged in multiple rows to correspond to the fitting holes 16.

A sub-fitting hole 135 having the same shape as that of the fitting hole 16 is further formed in a center of the horizontal frame 13. The sub-fitting hole 135 is used to connect the main body 10 to the corner. This will be described below in greater detail.

Such a configuration allows the vertical frame 12 and the horizontal frame 13 to be firmly coupled to each other through the coupling method of the fitting protrusion 15 with the fitting hole 16. A user places the support plate 14 on the holding part 133 of the horizontal frame 13 connected to each edge, thus defining one storage part 11.

In addition, the fitting hole 16 and the fitting protrusion 15 will be described in greater detail with reference to FIGS. 2A, 2B, 3A, 3B, and 3C.

First, the fitting protrusion 15 is integrally formed on the connection part 131 of the horizontal frame 13 to firmly ensure a support force generated by the fitting protrusion 15.

The fitting protrusion 15 includes a body part 153 protruding from the connection part 131, and a wing part 155 connected with the body part 153 to protrude therefrom.

Preferably, the wing part 155 is bent to protrude further from the body part 153, but is not an essential component.

While the wing part 155 is fitted into the fitting hole 16, the wing part 155 is in contact with an inner surface (surface in the spacing groove 124) of the vertical frame 12 on both sides of the fitting hole 16, so that the horizontal frame 13 is fixed to the vertical frame 12. In this case, the body part 153 supports a vertical load of the vertical frame 12, and the wing part 155 supports a diagonal load inwards of the vertical frame 12.

The fitting hole 16 includes an upper wide part 161 that is formed to be wider than the wing part 155, a lower narrow part 163 that is narrower (slightly smaller or equal) than the body part 153 to allow the body part 153 to be interference-fitted therein, and an intermediate width part 165 that connects the wide part 161 with the narrow part 163 is narrower than the wide part 161 and is wider than the narrow part 163.

That is, the widths of the fitting hole 16 are formed to have the following relationship: wide part 161>width part 165>narrow part 163.

Therefore, if the fitting protrusion 15 is inserted into the wide part 161, the body part 153 is primarily fitted into the width part 165 by the load of the horizontal frame 13. In this state, if the horizontal frame 13 is struck using a tool such as a hammer, the fitting protrusion 15 is firmly fitted into the fitting hole 16 while the body part 153 is interference-fitted into the narrow part 163.

After the horizontal frames 13 are assembled in a rectangular shape with the vertical frames 12 that are arranged to be parallel to each other, using the fitting protrusion 15 and the fitting hole 16, the support plate 14 is seated on the holding part 133 to be supported thereon. Thereby, it is possible to store things on the support plate 14.

In this case, since the support plate 14 is seated on the inner side of the vertical frame 12, namely, between the first support part 121 and the second support part 122 that are perpendicularly connected to each other, a separate fixing operation is not required. A bolt fastening hole 133*a* may be further formed on the holding part 133, so that the support plate 14 seated on the holding part 133 may be fastened by a bolt.

The main body 10 configured as such is advantageous in that the height of the support plate 14 may be variously changed by coupling the horizontal frame 13 to any one of the fitting holes 16 of the vertical frame 12, the entire height of the shelf may be changed using an extension bracket 90 that will be described later, and consequently it is unnecessary to use the bolt when the shelf is assembled, thus making it easy and convenient to assemble the shelf.

FIGS. 4A, 4B, 4C, 4D, 5A, and 5B show a configuration wherein a door 33 may be assembled with the prefabricated shelf assembly according to the present invention. The door unit 30 (including the door 33) may be provided on any one of the plurality of storage parts 11. The door unit is provided on the front of the storage part 11 to open or close the storage part 11.

Figure 4A:
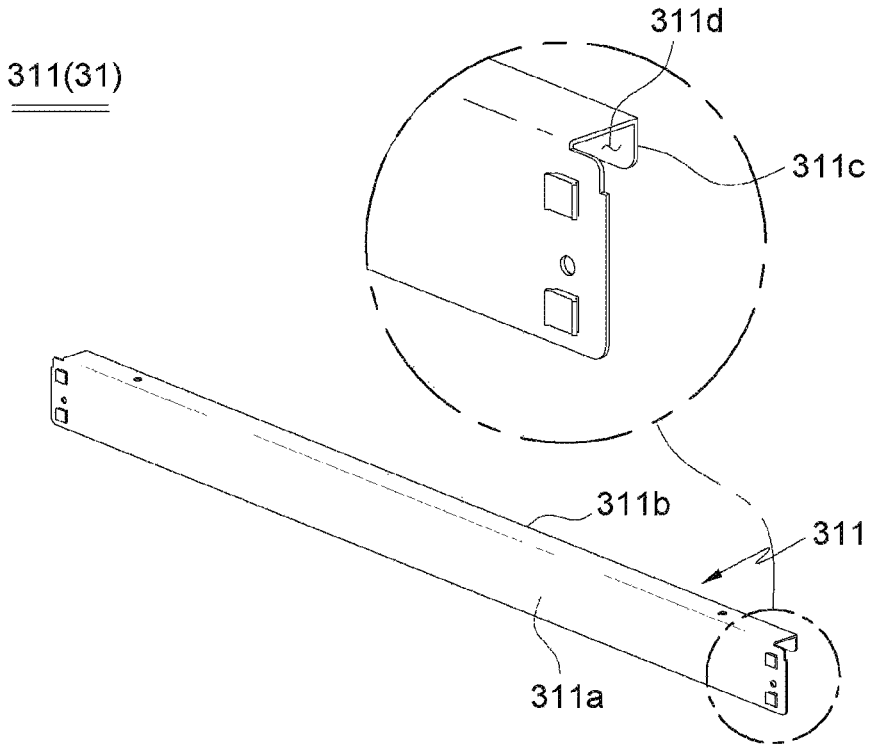
FIGS. 4A and 4B are detailed views showing an upper rail according to the present invention.
Figure 4B:
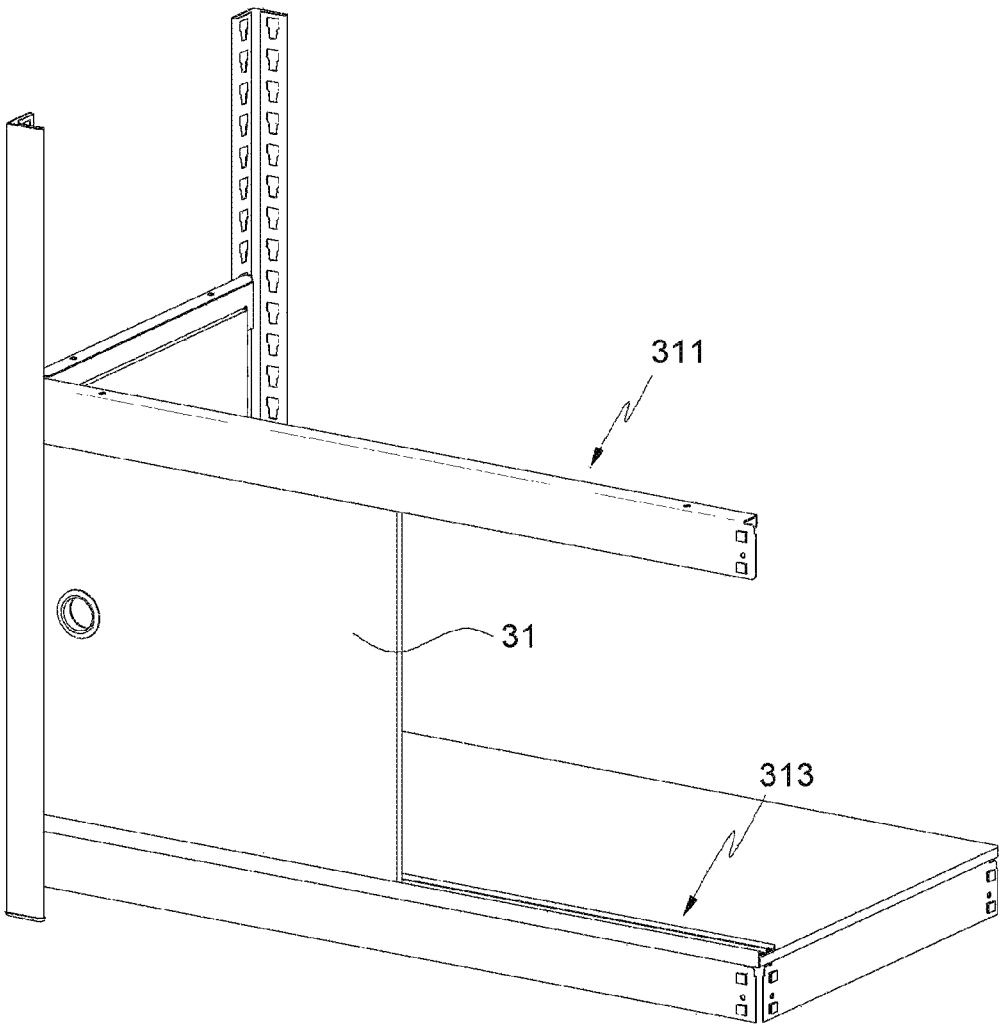
Figure 4C:
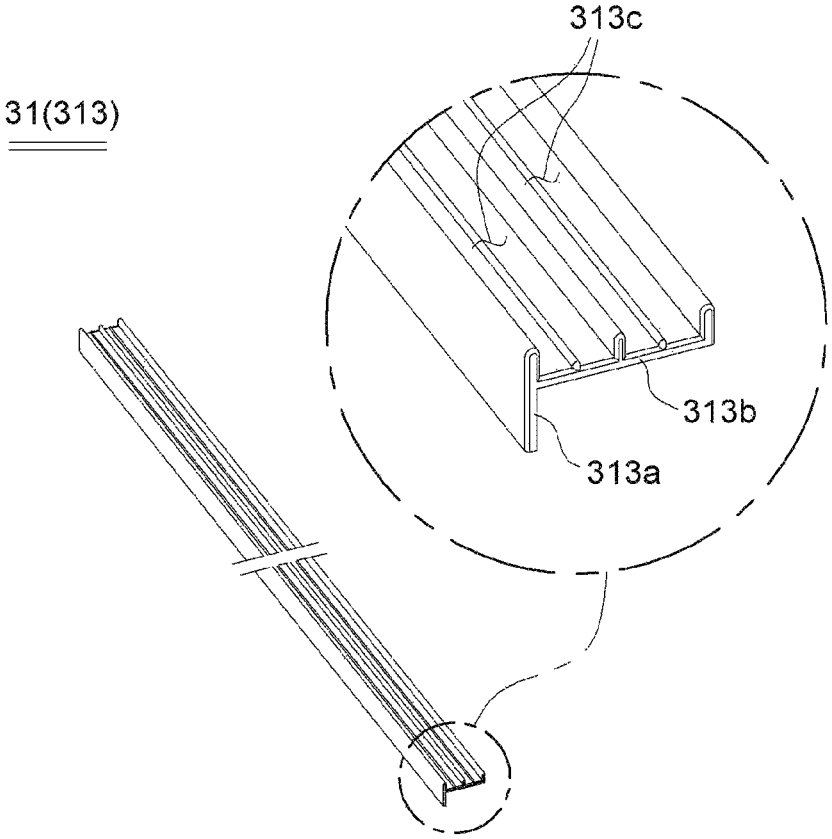
FIGS. 4C and 4D are detailed views showing a lower rail according to the present invention.
Figure 4D:
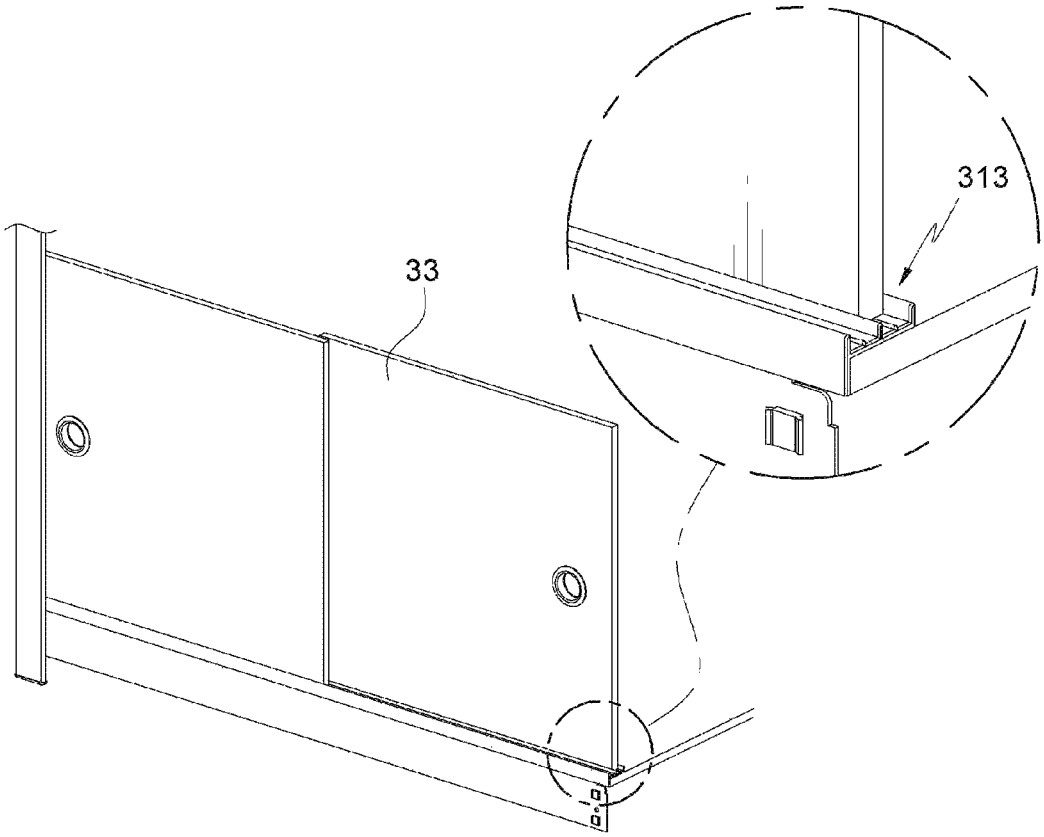

In detail, the door unit 30 includes the upper rail 311 shown in FIGS. 4A and 4B, and a lower rail 313 shown in FIGS. 4C and 4D to allow the door 33 to be slidably moved along the rails (herein, a rail 31 includes the upper rail 311 and the lower rail 313).

First, the upper rail 311 is described with reference to FIGS. 4A and 4B. The upper rail 311 includes a front connection part 311*a* that has on both sides thereof fitting protrusions in the shape similar to that of the horizontal frame 13, an upper holding part 311*b* that is provided on an upper portion of the front connection part 311*a* to be bent therefrom, and the rail forming part 311*c* that is bent downwards from the upper holding part 311*b* to be spaced apart from the front connection part 311*a* as described above, thus defining an upper rail groove 311*d*.

Thus, if the door 33 is coupled to the shelf assembly, the upper portion of the door 33 is introduced into the rail forming part 311*c* to safely slide leftwards and rightwards. All the horizontal frames 13 may be replaced with the upper rail 311 to allow a user to assemble the door 33 if necessary, and the upper rail 311 and the horizontal frame 13 may be separately configured. The scope of the invention is not limited thereto.

FIGS. 4C and 4D illustrate the lower rail 313. The lower rail 313 is different in structure from the upper rail 311, and is configured to be easily fitted into the front of the storage part 11.

First, the lower rail 313 includes a fitting plate 313*a* that has the shape of a plate and is fitted into the front of the support plate 14 placed on the holding part 133, and a bottom plate 313*b* that is perpendicularly provided on the fitting plate 313*a* to define a lower rail groove 313*c*. A plurality of rail protrusions is provided on the bottom plate 313*b* to define the lower rail groove 313*c*.

That is, in the case of installing the lower rail 313, the support plate 14 is placed on the holding part 133, and the fitting plate 313*a* is fixedly fitted into the front of the support plate 14. Consequently, both sides of the lower rail 313 are located between any one of the support parts of the vertical frame 12 and the support plate 14.

Here, a gap between the support plate 14 and the vertical frame 12 is narrow, so that the lower rail 313 is interference-fitted into the gap. A degree to which the fitting plate 313*a* protrudes downwards is equal to or less than the thickness of the support plate 14 to make the bottom plate 313*b* be in close contact with the upper surface of the support plate 14.

Figure 5A:
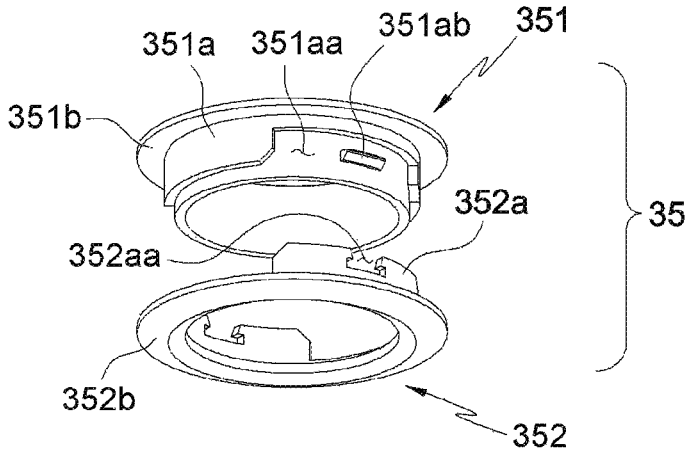
FIGS. 5A and 5B are detailed views showing a door according to the present invention.
Figure 5B:
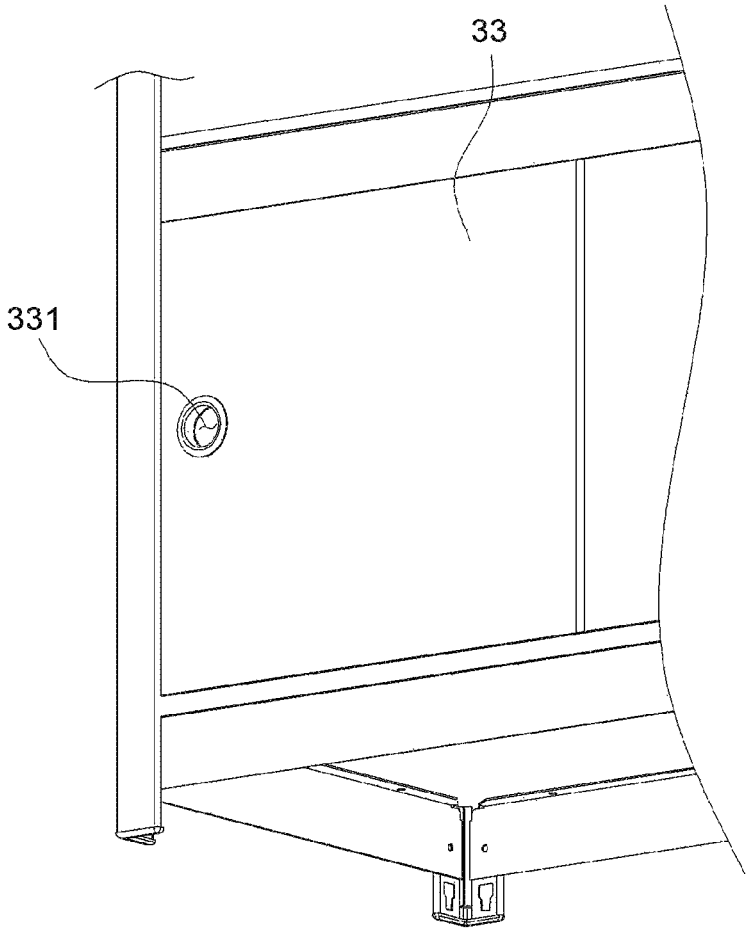

FIGS. 5A and 5B illustrate the door 33 that is provided to slide along the upper rail 311 and the lower rail 313. The door has the shape of a plate to slide along a rail 31 (it collectively refers to the upper rail 311 and the lower rail 313), a handle hole 331 is formed in the door 33, and a handle frame 35 is provided in the handle hole 331.

The handle frame 35 is provided to achieve a high quality, close the handle hole 331, and increase durability. The handle frame is configured such that a first handle 351 and a second handle 352 are coupled to both sides.

In detail, the first handle 351 includes a cylindrical body 351*a*, and a first outer flange part 351*b* that is provided on a side of the body 351*a* to have a larger diameter.

The second handle 352 includes a coupling projection 352*a* that is coupled to a side of the cylindrical body 351*a*, and a circular second outer flange part 352*b* that is provided on a side of the coupling projection 352*a*.

A coupling groove 351*aa* is formed in the body 351*a* so that the coupling projection 352*a* is introduced into the coupling groove. A fastening protrusion 351*ab* is provided on the coupling groove 351*aa*, and a fastening hole 352*aa* is formed in the coupling projection 352*a* so that the fastening protrusion 351*ab* is fitted into the fastening hole. Thus, the first handle 351 and the second handle 352 may be fitted into both sides of the handle hole 331 to be firmly coupled to each other.

As the first outer flange part 351*b* and the second outer flange part 352*b* are in close contact with the periphery of the handle hole 331, such a configuration prevents the handle frame 35 from being removed and provides a good appearance.

Figure 6A:
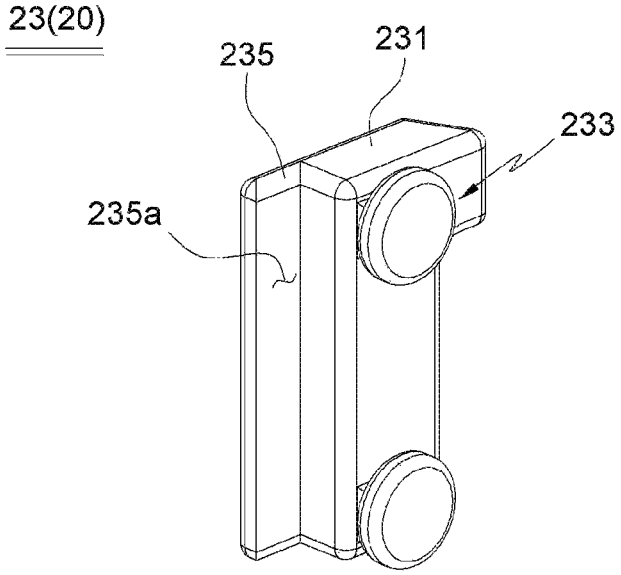
FIGS. 6A and 6B are detailed views showing a bracket for an outer wall according to the present invention.
Figure 6B:
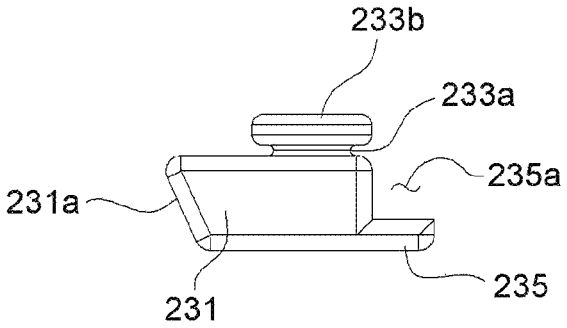
Figure 6C:
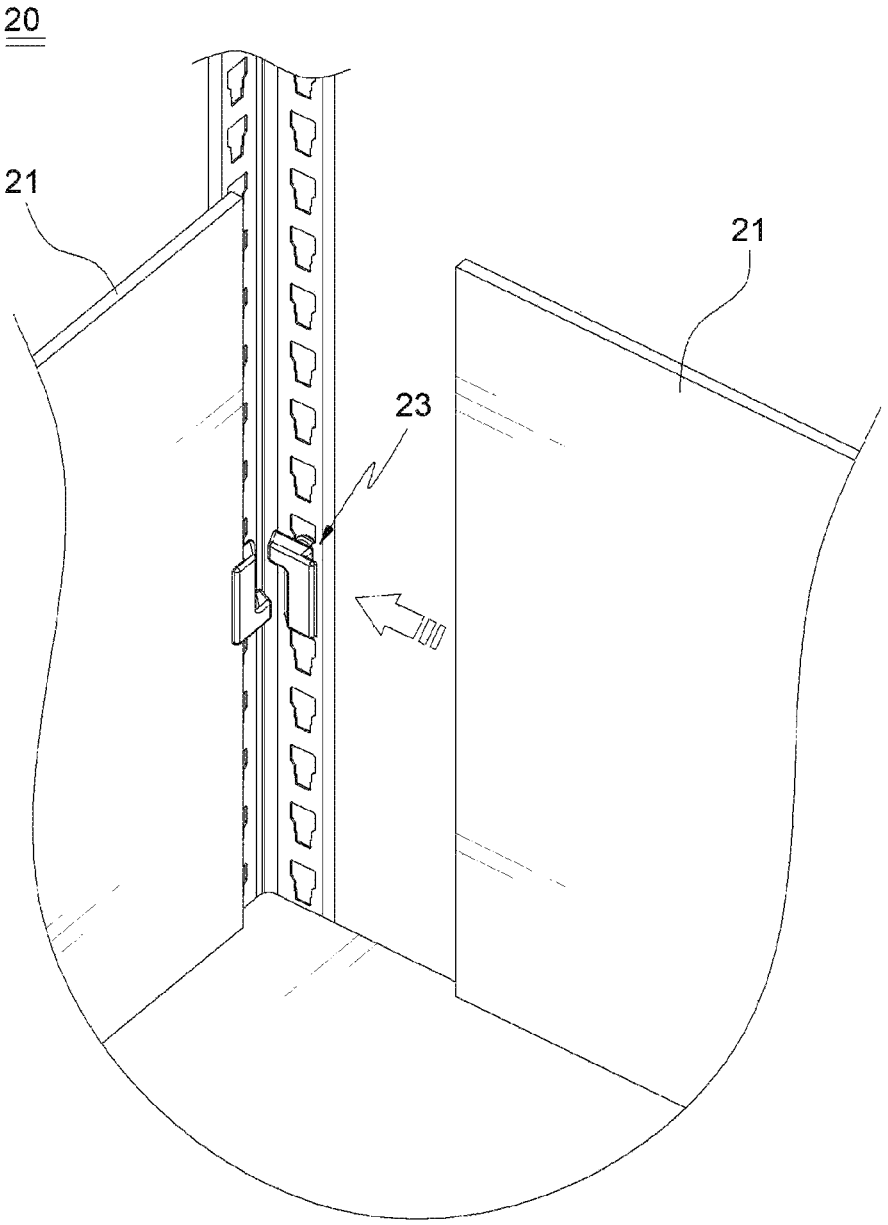
FIG. 6C is a diagram implementing the bracket for the outer wall according to the present invention.

FIGS. 6A, 6B, and 6C illustrate an outer-wall bracket 23 and an outer wall 21 constituting the outer-wall unit 20 provided on the main body 10, which will be described in detail with reference to the drawings.

First, the outer-wall bracket 23 is configured to support the inner side of the outer wall 21, thus allowing a user to easily assemble the outer wall 21.

The outer-wall bracket includes a body 231, a coupling protrusion 233 provided on a side of the body 231 to be coupled to the fitting hole 16, and a bearing part 235 provided on the body 231 to bear the inner side of the outer wall 21 provided on the storage part 11.

In detail, the outer-wall bracket 23 is secured to the fitting hole 16 of the vertical frame 12. The coupling protrusion 233 is provided on a side of the body 231. The coupling protrusion 233 includes a pillar part 233*a*, and a head part 233*b* having a diameter larger than that of the pillar part 233*a*. Both the pillar part 233*a* and the head part 233*b* have circular shapes.

In other words, the pillar part 233*a* has a diameter to be interference-fitted into the narrow part 163 of the fitting hole 16, and the head part 233*b* is provided to pass through the wide part 161 and then be seated into the spacing groove 124.

Furthermore, the bearing part 235 is provided on the body 231 to protrude therefrom. The bearing part 235 is formed to be narrower than the body 231 to define an outer-wall seat part 235*a*. A diagonal cutting part 231*a* is provided on a side opposite to the bearing part 235 and is cut diagonally to prevent two outer-wall brackets 23 adjacent to the corner from interfering with each other.

The outer wall 21 has the shape of a plate similarly to the door 33. The assembling method of the outer wall is as follows: if the outer wall 21 is located at an outer position inside the storage part 11, the upper and lower portions of the outer wall 21 are supported by the connection part 131 of the horizontal frame 13. At this time, the outer-wall bracket 23 is fixed. Both left and right sides of the outer wall 21 are located in the bearing part 235 of the outer-wall bracket 23, more precisely, in the outer-wall seat part 235*a* to be supported by the bearing part 235, thus preventing the outer wall 21 from falling down.

According to the present invention, a plurality of main bodies 10 may be arranged, a plurality of vertical frames 12 may extend, and an assembly kit K may be further provided. The assembly kit includes at least one of various brackets so that not the outer wall 21 but a grid wall or a fixing rod may be installed on a side surface of the shelf assembly.

Hereinafter, each of the brackets will be described in detail with reference to the accompanying drawings.

Figure 7:
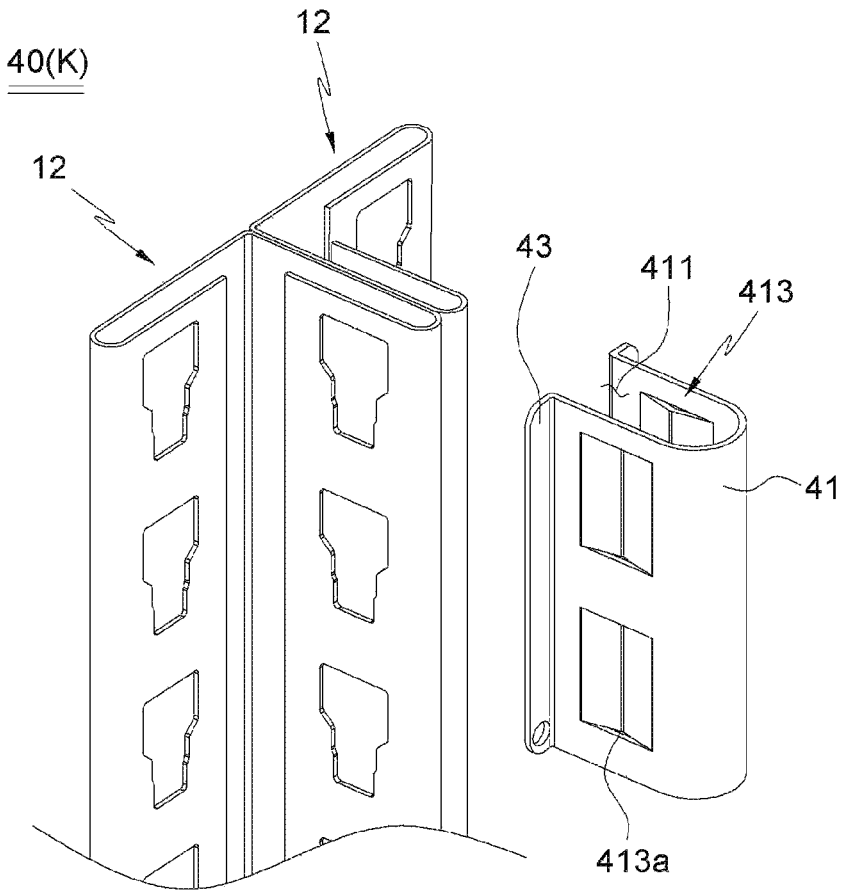
FIG. 7 is a detailed view showing a fixing clip for fixing a pillar frame according to the present invention.

First, FIG. 7 illustrates a connection bracket used when the main bodies 10 are arranged to be parallel to each other, namely, a fixing clip 40.

The fixing clip fixes the neighboring vertical frames 12 to firmly fix the main bodies 10.

In detail, the fixing clip 40 includes a clip body 41 that has an 'U' shape to define a receiving part 411 therein, and flanges 43 that are provided on both ends of the clip body 41 to protrude outwards. The clip body 41 further includes an elastic support piece 413 protruding towards the receiving part 411.

In detail, first, the elastic support piece 413 is integrally formed on the clip body 41, and has a vertical cutting part 413*a* to protrude towards the receiving part 411.

When the fixing clip 40 is adjacent to the vertical frame 12, the fixing clip is fitted over a pair of support parts to surround the support parts (the first support part 121 or the second support part 122) that are in close contact with each other, thus preventing the supports parts from being separated from each other.

In other words, the support parts coming into close contact with each other are introduced into the receiving part 411. In this case, the elastic support piece 413 is fitted into the fitting holes 16 formed in the support parts that are in close contact with each other, thus preventing the fixing clip 40 from being easily removed.

Furthermore, the flange 43 may come into close contact with the inner side of the vertical frame 12, thus obtaining a higher support force.

Therefore, even if a user arranges the plurality of main bodies 10 side by side, the vertical frames 12 of the adjacent main bodies 10 that are different from each other are fixed to each other by the fixing clip 40, thus further enhancing durability.

Figure 8A:
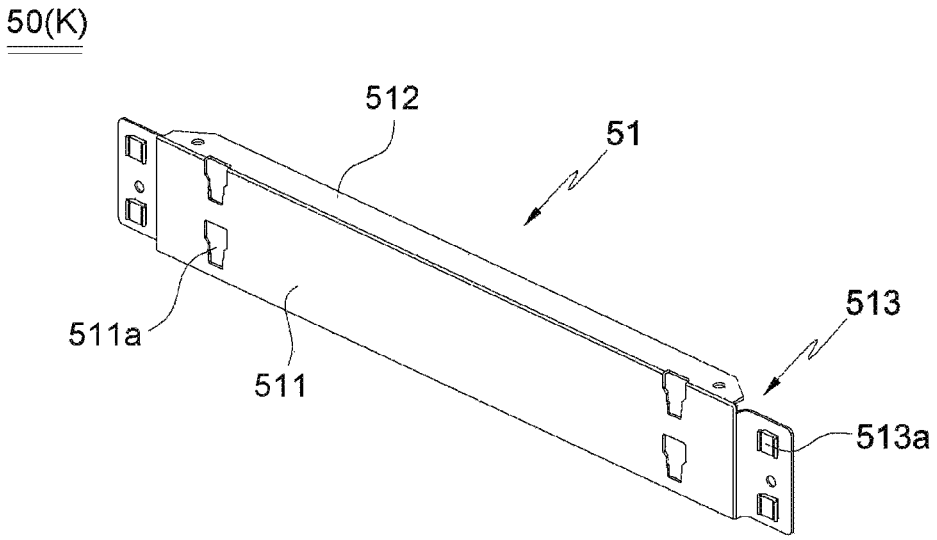
FIGS. 8A and 8B are detailed views showing a main body connection bracket according to the present invention.
Figure 8B:
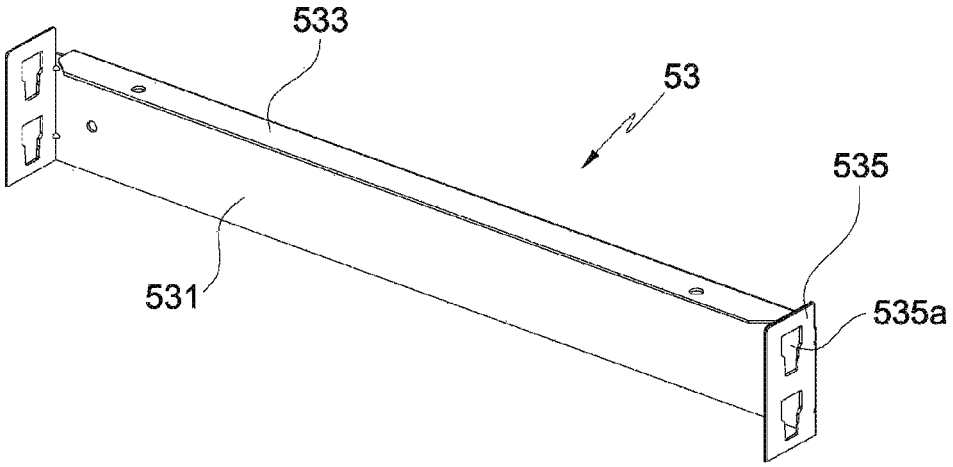
Figure 8C:
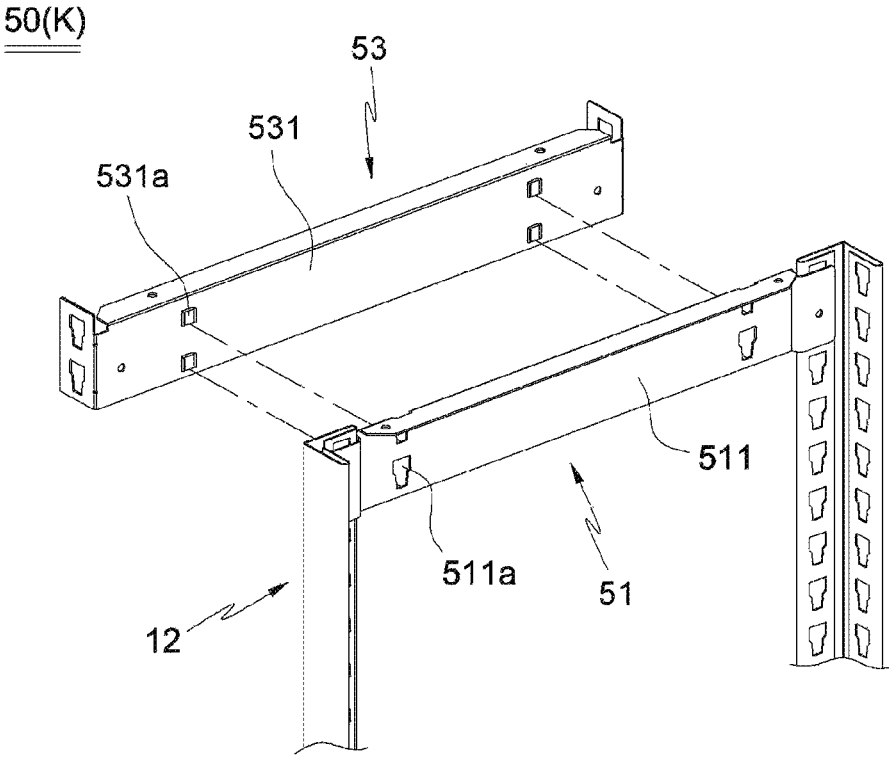
FIG. 8C is a diagram implementing the main body connection bracket according to the present invention.

FIGS. 8A, 8B, and 8C illustrate another bracket. That is, the drawings are related to inside and outside brackets 50 that are provided on both sides of one vertical frame 12 to be used to connect the horizontal frame 13 thereto.

This may be applied to a case where two main bodies 10 are connected to each other, for example. Two vertical frames 12 are arranged at edges of the neighboring main bodies 10. In order to efficiently utilize a space, either of the vertical frames 12 is eliminated, and the bracket is used to couple the horizontal frame 13 to both sides of one vertical frame 12.

This is the bracket that is required because the fitting hole 16 of the vertical frame 12 according to the present invention is formed only on the inner side.

This includes an inside bracket 51 that is coupled to the inner side of the vertical frame 12 with respect to any one of the vertical frames 12, and an outside bracket 53 that is coupled to the inside bracket 51 and is located at the outer side (outer side of the shelf) of the vertical frame 12.

First, since it is apparent that the inside bracket 51 and the outside bracket 53 include connection parts 511 and 531 and holding parts 512 and 533 provided on the upper portions of the connection parts, similarly to the horizontal frame 13, the detailed description thereof will be omitted herein.

FIG. 8A illustrates the inside bracket 51, which is different from the general horizontal frame in that inner step parts 513 are formed on both sides of the connection part 511 to be stepped inwards, and a fitting protrusion 513*a* is formed on each of the inner step parts 513.

Further, fitting holes 511*a* are formed in the connection part 511 to be spaced apart from each other.

Thus, as shown in FIG. 8C, if the fitting protrusion 513*a* of the inner step part 513 is coupled to the vertical frame 12, the connection part 511 is located to be level with the outer surface of the vertical frame 12 due to a height difference between the inner step part 513 and the connection part 511. At this time, the outside bracket 53 is coupled to the inside bracket 51.

The outside bracket 53 will be described below. A fitting protrusion 531*a* may be provided on the connection part 531 to be fitted into the fitting hole 511*a* formed in the inside bracket 51. Sidewalls 535 are provided on both sides of the connection part 531 to be bent inwards, and a fitting hole 535*a* is formed in each of the sidewalls 535.

Therefore, if the inside bracket 51 and the outside bracket 53 are connected to each other, they are assembled with each other as shown in FIG. 8C. At this time, as the fitting protrusion 15 of another horizontal frame is fitted into the fitting hole 535*a* formed in the sidewall 535, it is possible to couple the horizontal frames 13 to both sides of one vertical frame 12.

Figure 9A:
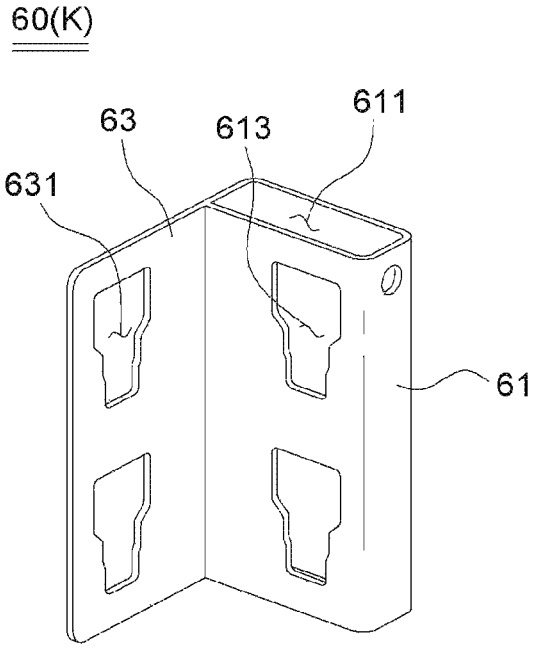
FIGS. 9A, 9B, and 9C are detailed views showing a corner connection bracket according to the present invention.
Figure 9B:
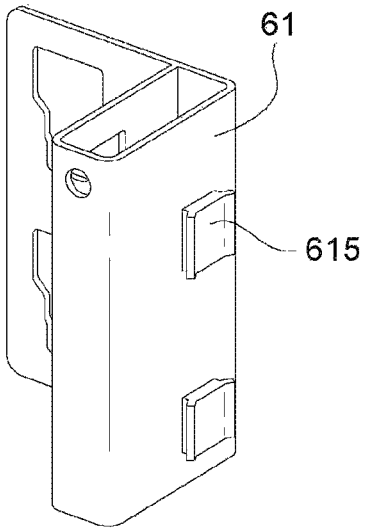
Figure 9C:
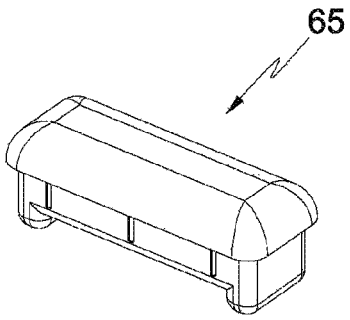
Figure 9D:
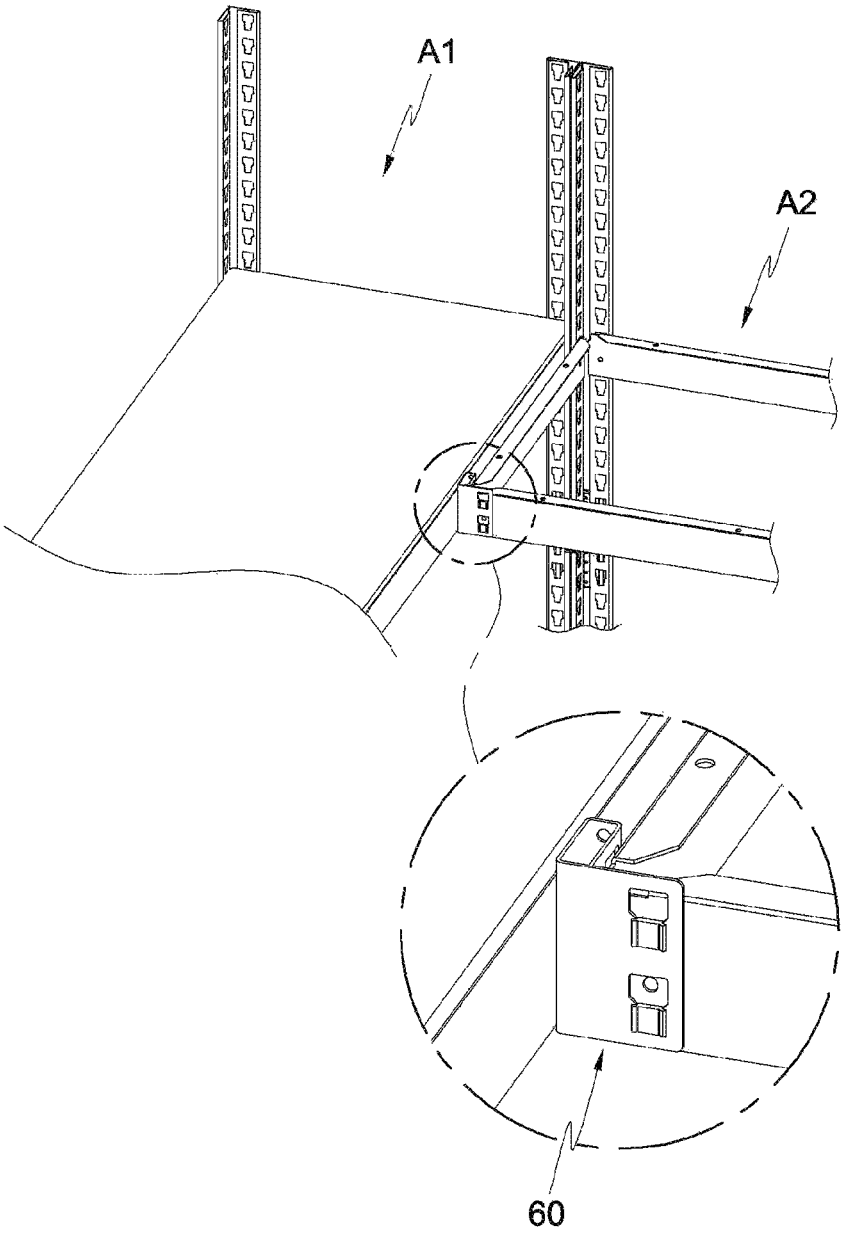
FIG. 9D is a diagram implementing the corner connection bracket according to the present invention.

FIGS. 9A, 9B, 9C, and 9D illustrate a corner bracket 60, which is used when two neighboring main bodies 10 are perpendicularly arranged (see FIG. 9D).

The corner bracket 60 includes a body 61 that defines a space 611 therein, and a plate 63 that extends from a side of the body 61 and is perpendicular thereto to form an "L" shape similarly to the body 61.

In this regard, a fitting hole 613 is formed in one surface of the body 61 (a side adjacent to the plate 63), a fitting hole 631 is also formed in the plate 63, and a fitting protrusion 615 is provided on the other surface of the body 61 (a surface opposite to the surface having the fitting hole 613).

First, when the corner bracket 60 is disposed on the corner of the main body 10, the corner bracket is in close contact with a side surface of the shelf that is perpendicularly adjacent to the front of the shelf. Thus, this bracket fixes two main bodies to each other to ensure stability, and gets rid of one vertical frame 12 to enhance the convenience of use.

For the convenience of description, in FIG. 9D, a left shelf is referred to as a first shelf A1, and a right shelf is referred to as a second shelf A2. In order to clearly show a coupling relationship, the support plate 14 of the second shelf A2 is not shown in the drawing.

First, if two main bodies 10 are simply arranged as shown in the drawing, one vertical frame 12 should be provided on a portion shown by a one-dot chain line of FIG. 9D. If the vertical frame 12 is provided, it is difficult to take things out of the corner of the first shelf A1, it degrades the appearance, and limits a storage space.

Therefore, the corner bracket 60 is intended to solve the above-described problems and firmly fix the two main bodies 10.

First, the fitting protrusion 615 provided on the body 61 is fastened to the sub-fitting hole 135 formed in the horizontal frame 13 of the first shelf A1. The fitting protrusion 15 of the left horizontal frame 13 of the second shelf A2 is fastened to the fitting hole 613 formed in the body 61.

Furthermore, the fitting protrusion 15 of the front horizontal frame 13 of the second shelf A2 is fastened to the fitting hole 631 formed in the body 63. In this manner, the first shelf A1 and the second shelf A2 may be firmly fixed to each other.

As shown in the drawings, the space 611 is formed in the body 61 in consideration of the width of the support part of the vertical frame 12 coming into close contact with the first and second shelves. In addition, the space 611 ensures a space to accommodate the fitting protrusion, when the fitting protrusion is fitted into the fitting hole 613 formed in the body 61.

Moreover, if the space 611 is exposed to the outside, the appearance becomes poor, and foreign matter may enter the shelf. In order to solve these problems, as shown in FIG. 9C, it is preferable that a corner closure member 65 is further provided to be fitted into the upper portion of the space 611.

Figure 10A:
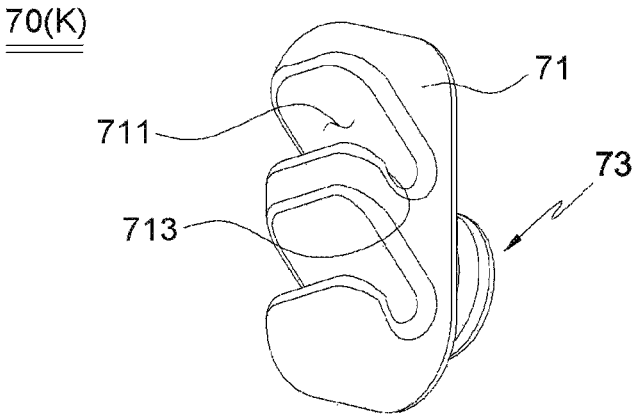
FIGS. 10A and 10B are detailed views showing a grid-wall bracket for connecting a grid wall according to the present invention.
Figure 10B:
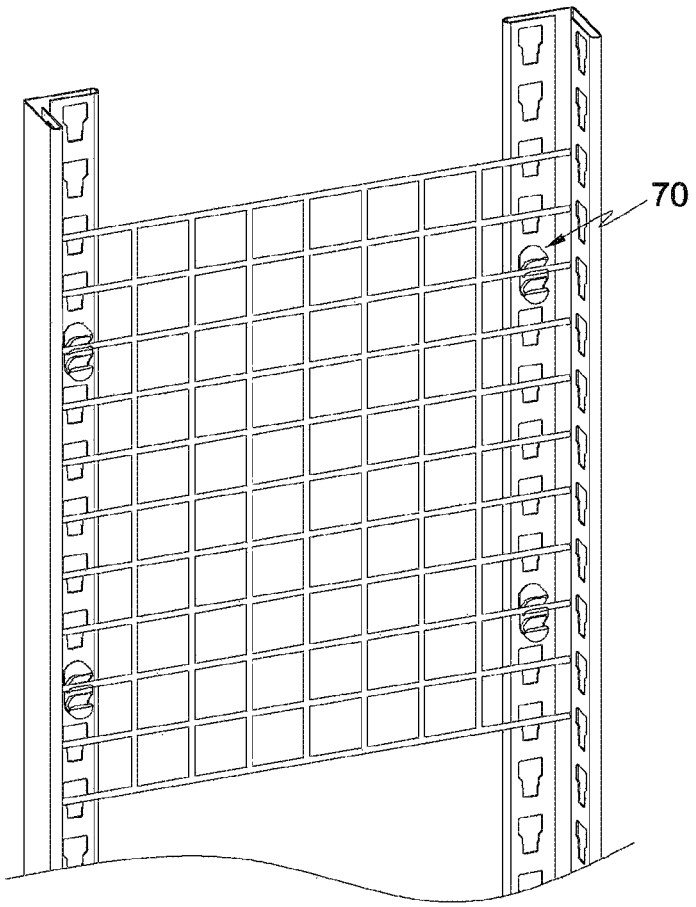

FIGS. 10A and 10B illustrate a grid-wall bracket 70 that is provided to allow a hanger or the like to be hung onto a grid wall that is provided on a side of the shelf where no outer wall 21 is formed.

The grid-wall bracket 70 includes a body 71, and a coupling protrusion 73 provided on a side of the body 71 to be fitted into the fitting hole 16. A fixing recess 711 is formed in the body 71 to be downwardly inclined in a diagonal direction, and a locking step 713 is provided on an end of the fixing recess 711, namely, the deepest place to prevent the removal of the grid wall.

Since the coupling protrusion 73 has the same shape as the above-described coupling protrusion 233 provided on the outer-wall bracket 23, the detailed description thereof will be omitted herein.

If the grid-wall bracket 70 is coupled to the fitting hole 16 of the vertical frame 12 and then a user fits the grid wall into the fixing recess 711 from an upper position to a lower position in the diagonal direction, a convenient assembly is realized, thus improving the convenience of use and assembly. The grid wall is not easily removed by the locking step 713, and the plurality of fixing recesses 711 is provided to allow an installation height to be changed as desired.

Figure 11A:
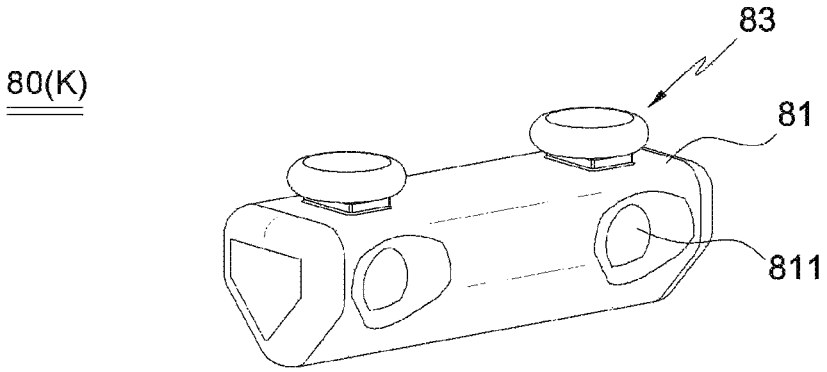
FIGS. 11A and 11B are detailed views showing a fixing-rod bracket for connecting a fixing rod according to the present invention.
Figure 11B:
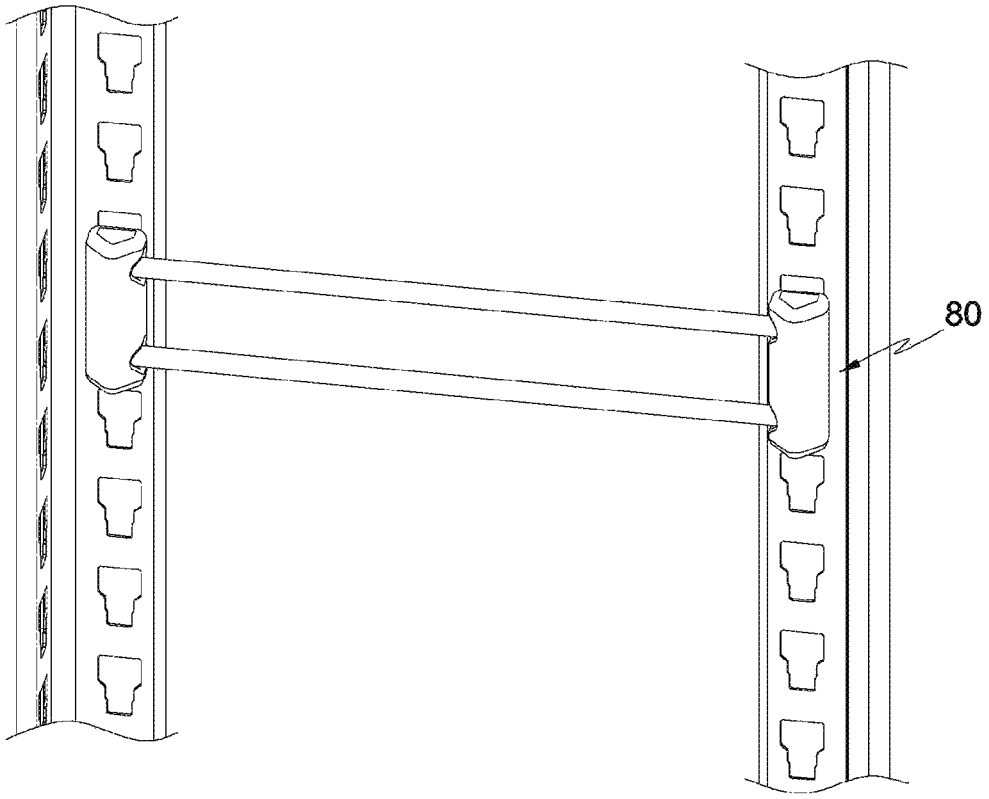

FIGS. 11A and 11B are similar to FIGS. 10A and 10B, and illustrate a fixing-rod bracket 80 for installing a fixing rod.

As shown in the drawings, the bracket includes a body 81 and a coupling protrusion 83. Similarly to the grid-wall bracket 70, a fixing recess 811 is formed in the body 81 to allow the fixing rod to be coupled between a pair of fixing-rod brackets 80. Since this bracket is similar to the above-described grid-wall bracket 70 in terms of its use and mounting method, the detailed description thereof will be omitted herein.

Figure 12:
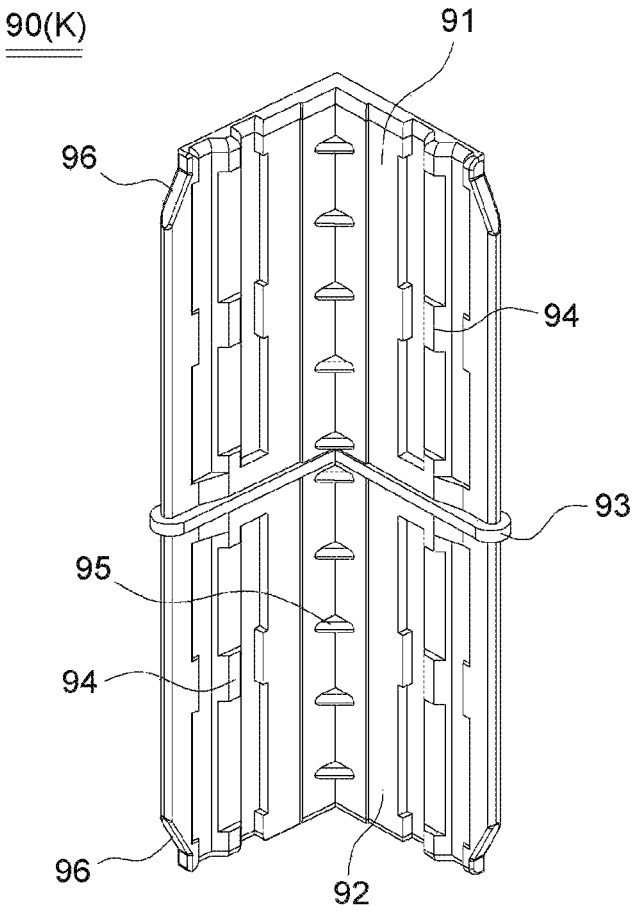
FIG. 12 is a detailed view showing an extension bracket for extending the vertical frame according to the present invention.

FIG. 12 illustrates an extension bracket 90 that connects two vertical frames 12 to each other to change the height of the shelf. The configuration of the extension bracket will be described with reference to FIGS. 1 and 12.

First, the entire shape of the extension bracket 90 has an 'L' shape which is the same as the vertical frame 12. The extension bracket may be divided into a lower fitting part 92 and an upper fitting part 91, and a stopping protrusion 93 is formed between the lower fitting part 92 and the upper fitting part 91 to protrude therefrom.

The upper and lower parts of the extension bracket 90 are shaped to be symmetrical with respect to the stopping protrusion 93. When two vertical frames 12 are arranged in a vertical direction, the lower fitting part 92 is introduced into the lower vertical frame 12, and the upper fitting part 91 is introduced into the upper vertical frame 12.

More precisely, the upper fitting part 91 and the lower fitting part 92 are fitted into the space of the vertical frames 12.

The stopping protrusion 93 performs two functions, namely, the function of evenly distributing force by introducing the same area into two vertical frames 12, and the function of preventing the extension bracket 90 from slipping down when the extension bracket 90 is fitted into the lower vertical frame 12.

That is, the stopping protrusion 93 is located between ends of two vertical frames 12.

In addition, in order to enhance stability and durability, a plurality of frictional protrusions 94 is provided on the inner sides of the upper and lower fitting parts 91 and 92 to increase a frictional force and be fitted into the fitting holes 16 of the vertical frames 12, thus preventing the extension bracket from being removed as long as a predetermined force is not applied thereto. An entry guiding part 96 inclined in a diagonal direction is further provided on each vertex to make it easier to couple the vertical frames, thus enhancing the convenience of assembly.

Moreover, a plurality of reinforcing ribs 95 is provided on the corner of the extension bracket to enhance durability.

Although the present invention was described with reference to specific embodiments shown in the drawings, it is apparent to those skilled in the art that the present invention may be changed and modified in various ways without departing from the scope of the present invention, which is described in the following claims.

What is claimed is:

1. A prefabricated shelf assembly comprising:

a main body comprising: a vertical frame including a first support part, a second support part, and a plurality of fitting holes formed in the first and second support parts; and a horizontal frame including a connection part and a holding part, with fitting protrusions being provided on both sides of the connection part to be fitted into the fitting holes, wherein the vertical frame and the horizontal frame are coupled to define a plurality of storage parts of the main body;

a support plate configured to be held on the holding part of the horizontal frame;

an outer-wall unit provided on some or all of the storage parts, and including an outer wall provided on either or both of a side surface and a rear surface of each of the storage parts, and an outer-wall bracket coupled to the vertical frame to support a rear end of the outer wall; and a door unit provided on some or all of the storage parts, and including a rail provided on a front of the storage part, and a door coupled to slide along the rail and opening or closing the storage part, wherein the rail of the door unit comprises an upper rail and a lower rail to which upper and lower portions of the door are slidably coupled, and the upper rail comprises a front connection part having on both ends thereof fitting protrusions to be coupled to the vertical frame, an upper holding part bent from an upper portion of the front connection part, a rail forming part bent downwards from a rear end of the upper holding part, and an upper rail groove formed between the front connection part and the rail forming part.

2. The prefabricated shelf assembly of claim 1, wherein the outer-wall bracket of the outer-wall unit comprises a body, a coupling protrusion provided on a side of the body to be coupled to the fitting hole, and a bearing part provided on the body to bear the outer wall provided on the storage part so that outer sides of upper and lower portions of the outer wall are supported by the horizontal frame, and inner sides of the left and right sides of the outer wall are supported by the outer-wall bracket to be fixed to the storage part.

3. The prefabricated shelf assembly of claim 2, further comprising an assembly kit including at least one of the following:

a connection bracket used when a plurality of main bodies is arranged to be parallel to each other;

a corner connection bracket used when the plurality of main bodies is arranged on a corner;

an extension bracket used to extend another vertical frame above the vertical frame;

a grid-wall bracket used to install a grid wall on a side surface of the assembly; and a fixing-rod bracket used to install a fixing rod on the side surface of the assembly.

4. The prefabricated shelf assembly of claim 1, further comprising an assembly kit including at least one of the following:

a connection bracket used when a plurality of main bodies is arranged to be parallel to each other;

a corner connection bracket used when the plurality of main bodies is arranged on a corner;

an extension bracket used to extend another vertical frame above the vertical frame;

a grid-wall bracket used to install a grid wall on a side surface of the assembly; and a fixing-rod bracket used to install a fixing rod on the side surface of the assembly.

* * * * *